United States Patent [19]

Jones

[11] Patent Number: 4,919,725

[45] Date of Patent: Apr. 24, 1990

[54] NOVEL DISPERSIBLE ACTIVE SIZING COMPOSITION

[75] Inventor: Mervyn F. Jones, Bristol, England

[73] Assignee: Albright & Wilson Limited, Warley, England

[21] Appl. No.: 225,608

[22] Filed: Jul. 26, 1988

Related U.S. Application Data

[63] Continuation of Ser. No. 102,773, Sep. 23, 1987, abandoned, which is a continuation of Ser. No. 907,628, Sep. 15, 1986, abandoned.

[30] Foreign Application Priority Data

Sep. 16, 1985 [GB] United Kingdom ..... 8522844

[51] Int. Cl.[5] ..... C08L 89/00

[52] U.S. Cl. ..... 106/218; 106/238; 162/180

[58] Field of Search ..... 106/218, 238; 162/180

[56] References Cited

U.S. PATENT DOCUMENTS

| | | | |
|---|---|---|---|
| 3,044,890 | 7/1962 | Boughton et al. | 260/97.5 |
| 4,333,732 | 6/1982 | Deubel et al. | 260/97.5 |
| 4,422,879 | 12/1983 | Poppel et al. | 106/238 |
| 4,522,686 | 6/1985 | Dumas | 106/238 |
| 4,540,635 | 9/1985 | Ronge et al. | 106/238 |
| 4,666,523 | 5/1987 | Yokota et al. | 106/213 |

FOREIGN PATENT DOCUMENTS

| | | |
|---|---|---|
| 1007289 | 5/1957 | Fed. Rep. of Germany . |
| 2140049 | 11/1984 | United Kingdom . |

OTHER PUBLICATIONS

"Surface Active Ethylene Oxide Adducts", Shönfeldt, Sep. 13, 1971, pp. 77, 78.

*Primary Examiner*—Theodore Morris
*Attorney, Agent, or Firm*—Frishauf, Holtz, Goodman & Woodward

[57] ABSTRACT

A water dispersible active sizing composition comprises an active size such as alkyl succinic acid and an effective proportion (e.g. 10–30% by weight) of a dispersant therefor, said dispersant comprising a polyalkoxylate of a rosin or fortified rosin, and/or a water dispersible organic derivative thereof such as a maleinate or succinate half ester.

23 Claims, No Drawings

NOVEL DISPERSIBLE ACTIVE SIZING COMPOSITION

This application is a continuation of application Ser. No. 102,773 filed Sept. 23, 1987, now abandoned, which is a continuation of U.S. Ser. No. 907,628 filed Sept. 15, 1986, now abandoned.

The present invention relates to active sizes containing a reactive sizing agent and dispersant.

Traditionally paper has been sized with rosin in conjunction with alum which acts as a precipitant. More recently active sizes have been introduced in which the rosin has been at least partially replaced by a sizing agent which reacts directly with cellulose. The two principal active sizes in common use are ketene dimer and alkyl succinic anhydrides. The latter are typically adducts of maleic anhydride and an olefin having from 10 to 22 carbon atoms.

Active sizes are typically used as emulsions in water in conjunction with dispersants to stabilise the emulsion, and retention agents to promote the retention of the size on the paper.

In practice the only commonly used dispersant, at least with alkyl succinic anhydrides, has been cationic starch. This has necessitated preparing the emulsion on site at the paper mill using special plant to heat the starch water mixture.

It has been suggested that certain nonionic surfactants including alcohol ethoxylates could be used as dispersants for active size, but most known surfactant-containing active sizes give poor sizing performance and/or rapid sedimentation. We have now discovered a novel method of dispersing active size using rosin based dispersants which provides reduced tendency to sedimentation and particularly effective sizing, the dispersant actually tending to enhance the sizing efficiency synergistically.

Our invention provides a water dispersible composition comprising an active sizing agent and an effective proportion of a dispersant therefor, said dispersant comprising a polyalkoxylate of a rosin or fortified rosin, and/or a water dispersible organic derivative thereof.

Rosin comprises laevopimaric acid which is a tricyclic monocarboxylic acid having two conjugated double bonds. Laevopimaric acid reacts with maleic or fumaric acids or their derivatives to form a tetracyclic Diels Alder adduct with three carboxy groups. The maleinised or fumarised rosin is called fortified rosin.

The dispersant may have the general formula:

$$H_{(v-n)}R(X_mR^1)_n$$

wherein:

R is a laevopimarate or wholly or partially fortified laevopimarate group having an average valency v;

each X is an ethyleneoxy or propyleneoxy group;

$R^1$ is hydrogen or a saturated or unsaturated hydrocarbon or carboxylate group having from 1 to 20 carbon atoms optionally substituted by one or more carboxyl, carboxylic anhydride or hydroxyl groups; and $v=1$ to 3

$n=1$ to v;

$m=4$ to 30.

R is preferably an at least 6% maleic or fumaric acid fortified gum or tall rosin.

Typically $R^1$ is a dicarboxylic acid half ester group such as a maleinate, succinate, itaconate or phthalate, or a carboxylic acid group such as formate, acetate, propionate, hexanoate, benzoate, stearate, palmitate, acrylate, oleate or linoleate, or a hydrocarbon group such as methyl, ethyl, propyl, butyl, lauryl, cetyl, stearyl, phenyl, nonylphenyl or benzyl group.

Especially preferred are maleinate and succinate half esters formed by reacting an alcohol of the formula $H_{(v-n)}R(X_mH)_n$ with maleic or succinic anhydride. The applicant believes that the invention would be operable with dispersants in which $R^1$ is a fumarate, malonate, adipate, pimelate, suberate, sebacate, citrate, lactate or tartrate group, but these are not preferred because they are difficult to prepare, due to non-availability of the corresponding anhydrides.

Rosin, or wholly or partially fortified rosin, may be reacted with polyalkylene glycols to form mono-, di-, or tri-esters which may, in turn, be reacted with maleic anhydride to form the corresponding maleinate half esters. The preparation of fortified rosin and of the aforesaid esters and half esters is described in our U.K. Patent Application No. 8506691.

The dispersants which are of particular use according to our invention are those polyalkylene glycol esters containing from 9 to 90, preferably 18 to 60, alkylene oxide groups in from one to three, preferably two, polyoxyalkylene chains, and the corresponding maleic acid half esters.

Preferably each chain contains an average of from 4.5 to 30, more preferably 6 to 20, alkylene oxide moieties, the upper part of the above range being preferred for the mono esters and the lower part for the tris esters. Preferably each polyalkyleneoxy chain has a molecular weight less than 2000, e.g. less than 1000.

The alkylene oxide moieties are preferably ethylene oxide but propylene oxide or mixed ethylene oxide/propylene oxide may also be used.

Typically the rosin or fortified rosin is reacted with a polyethylene glycol having a molecular weight of from 200 to 1,000 in proportions up to the stoichiometric amount, e.g. proportions of from 1 to 3 moles per mole of fortified rosin acid. If the molar proportion of polyethylene glycol per mole of rosin or fortified rosin acid is substantially less than 2:1 we prefer a polyethylene glycol having a molecular weight of 400 to 1,000, preferably 800. If the proportion of the glycol is substantially more than 2:1 then molecular weights in the range of 200 to 600, e.g. 400, are preferred. Where the molar proportion of glycol is substantially 2:1 (e.g. from 1.7:1 to 2.3:1) the molecular weight is preferably from 400 to 800, e.g. 600.

The polyethylene glycol laevopimarates are particularly effective dispersants for active size, where the sizing composition is to be used shortly after mixing, but may give rise to storage problems, due to reaction with the reactive size, if allowed to stand for a substantial period. For this reason maleinate half esters of the polyethylene glycol laevopimarates are preferred where a prolonged period of storage between preparation and use may be required.

Other carboxylic acid anhydrides may be used in place of maleic anhydride, e.g. succinic, itaconic or phthalic, however maleic is preferred.

Alternatively, but less preferably, fortified rosin may be esterified with a polyethoxylated non-ionic surfactant. The latter may be a polyethoxylated alcohol such as poly (e.g. 4 to 15 mole) ethoxylated ceto stearyl alcohol, polyethoxylated nonylphenol, or polyethoxylated sorbitan or glyceryl esters, or a polyethoxylated fatty acid such as palmitic stearic, oleic, or linoleic acid.

The rosin may be gum or tall rosin and may be fortified with maleic or fumaric acids or with any ester-forming dienophilic derivative thereof, such as maleic anhydride, or an acid chloride or transesterifiable ester. The degree of fortification may be from 0 to 100%, typically from 40 to 100%, molar based on the fortifiable acid content of the rosin. The latter range corresponds to 20 to 50% molar based on the total rosin, preferably at least 30%. Typically the rosin is reacted with from 6 to 18% by weight, preferably 10 to 16%, of maleic anhydride or fumaric acid.

The active size may be any sizing agent which is capable of reacting directly with cellulose to give effective sizing in the absence of precipitants such as alum. The preferred active sizes are alkyl or alkenyl succinic anhydrides prepared by reacting olefins having from 6 to 22 carbon atoms, preferably 10 to 20, e.g. 12 to 18, with maleic anhydride. Particularly preferred are branched chain and/or secondary alkyl succinic anhydrides. Other active sizes which may be used according to our invention include ketene dimer. Mixtures of active sizes may be used. Suitable active sizing products are described in, for instance, GB 2126260, GB 0141641 and GB 1492104.

The proportion of dispersant present in the composition of our invention is between 1% and 70% based on the total weight of active size and dispersant, preferably 3% to 50%, most preferably 6% to 40%, e.g. 10% to 30%. The optimum amount depends upon the particular dispersant selected. Generally it is not possible to obtain adequate dispersion, or effective sizing with less than about 1% by weight of dispersant, based on the total weight of the mixture of active sizing ingredient and dispersant and the majority require more than about 5%. Some of our dispersants are only fully effective above 10% by weight of the mixture. Most give an optimum sizing performance in concentrations between 10 and 20% by weight. Some, however, perform particularly well in concentrations up to 30% and our preferred dispersants have given highly effective sizing at concentrations greater than 40% of the weight of size and dispersant.

Even relatively modest sizing performance with mixtures of size and dispersant containing, e.g. 50% or more of the dispersant is significant, since the dispersant is substantially cheaper than the active size; but does not itself usually exhibit sizing properties. Thus any improved sizing effect obtained with mixtures of dispersants and active size according to our invention is a major commercial benefit and evidence of a marked synergism. Even equivalent or only slightly poorer performance may represent a cost effectiveness gain and indicates some synergism.

In general therefore we prefer to use the highest proportions of dispersant consistent with effective sizing.

Best results have been obtained with dispersants having an average chain length greater than six ethylene oxide moieties per chain, e.g. greater than 9 ethylene oxide moieties per chain, and less than 20 ethylene oxide moieties, e.g. less than 16 per chain. Particularly preferred are the diester having an average of from 10 to 15 ethylene oxide moieties per chain, e.g. 12.5 and the monoester having an average of from 6 to 10, e.g. 8 ethylene oxide moieties per chain. Maleinate half esters generally give superior sizing action to the corresponding unmaleinated esters.

The sizes of our invention are normally applied in conjunction with retention agents. These may be either anionic or typically cationic retention agents, which may optionally be present as additional components of the mixtures of our invention. Suitable materials include polyamides, polyimides, polyacrylamides and cationic starch, as well as cationic surfactants such as fatty alkyl quaternary ammonium salts. The composition of our invention may also include other additive for example antifoams, or other auxiliary chemicals.

Our compositions are dispersed or emulsified prior to use by stirring with water, typically in concentrations of 0.2 to 20%, preferably 0.2 to 15%, especially 0.5 to 5 e.g. 1% by weight of organic phase based on the total weight of the emulsion. The size emulsion is then applied to paper in the conventional manner, e.g. at a concentration of from 0.1 to 1%, e.g. 0.3% on fibre, and the paper is drained by application of a draining agent.

The invention is illustrated by the following examples:

EXAMPLES 1 TO 8

A. In each of these Examples, 100 gms of maleinated Chinese gum rosin was heated with various proportions of polyethylene glycol in the presence of 0.1 gm zinc oxide. The rosin was 16% fortified except for Example 8 which was 10% fortified.

B. 100 gms of the ester product of A was in each case reacted with a substantially stoichiometric amount of maleic anhydride at 90°-100° C. for 1 hour to form the maleinate half ester.

The details are set out in Table 1.

TABLE 1

| Example | mole wt. of polyglycol | gms of polyglycol per 100 gms rosin | esterification temp. | Duration of heating | gms of maleic anhydride per gms of ester |
|---|---|---|---|---|---|
| 1 | 600 | 171 | 260-270° C. | 3-4 hours | 10.4 |
| 2 | 400 | 114 | 260-270° C. | 3-4 hours | 13.2 |
| 3 | 1000 | 285 | 260-270° C. | 3-4 hours | 7.3 |
| 4 | 200 | 114 | 260-270° C. | 5 hours | 23.0 |
| 5 | 600 | 342 | 260-270° C. | 4 hours | 12.8 |
| 6 | 1000 | 570 | 260-270° C. | 4½ hours | 8.4 |
| 7 | 600 | 85.5 | 190-200° C. | 2 hours | 7.5 |
| 8 | 600 | 111 | 260-270° C. | 3-4 hours | 8.7 |

The glycol esters of A and the maleinated half esters of B were each mixed with an alkyl succinate anhydride sizing agent at 15% concentration. All gave a clear, light brown liquid which, on stirring with water, formed stable aqueous emulsions showing little or no sedimentation during normal mill retention periods.

EXAMPLE 9

Mixtures of alkyl succinic anhydride size containing varying proportions of esters prepared by the general method A above or of maleinates prepared by the general method B, were each emulsified in water and applied to paper, at a loading of 0.25% organics based on the weight of fibre, and in conjunction with a proprietory cationic retention agent.

The cobb values of the paper were measured and are shown in Table 2.

The Table shows the marked synergism between the dispersant and the size.

TABLE 2

| | | wt % of ester based on total weight of ASA + ester | 5 | 10 | 20 | 30 | 40 |
|---|---|---|---|---|---|---|---|
| Mono | 400 | succinate | — | 29 | 27 | 30 | 24 |
| " | 600 | " | — | 48 | 27 | 85 | 110 |
| " | 1000 | " | — | 37 | 23 | 114 | — |
| Di | 400 | " | 81 | 19 | 24 | 23 | 100 |
| " | 600 | " | — | 27 | 26 | 22 | 22 |
| " | 1000 | " | 124 | 34 | 21 | 27 | 133 |
| Tri | 200 | " | 43 | 35 | 43 | 137 | — |
| " | 600 | " | — | 25 | 30 | 32 | 31 |
| " | 1000 | " | — | 39 | 33 | 52 | 46 |
| Mono | 400 | alcohol | — | — | 130 | 106 | 107 |
| " | 600 | " | — | 129 | 30 | 31 | 137 |
| " | 1000 | " | — | 23 | 36 | 66 | 80 |
| Di | 600 | " | — | 27 | 27 | 30 | 35 |

In the left hand column the prefixes refer to the number of moles of polyethylene glycol reacted with each mole of fortified rosin and the numbers refer to the molecular weight of the polyethylene glycol.

Substantially similar results are obtained when the examples are repeated using fumarated gum rosin, or with maleinated or fumarated tall oil rosin.

EXAMPLE 10

100 gms of 16% maleinated gum rosin was heated at 260°–270° C. for 4–5 hours with two molar proportions of ceto stearyl alcohol ethoxylate/propoxylate.

The product forms a stable emulsion with alkyl succinic anhydride sizing agent and with ketene dimer, which emulsions give effective sizing.

EXAMPLES 11 TO 13

Example 10 was repeated using a $C_{12-15}$ synthetic alcohol five mole ethoxylate (Example 11) and two polyethylene glycol alkyls (Example 12 and 13). All formed stable emulsion with active size, which gave good sizing, especially Example 11.

EXAMPLES 14 TO 17

In these examples unfortified or partially maleinised rosin was used as the feedstock.

Example 14 used unfortified Chinese gum rosin, Examples 15 to 17 all used 6% maleinised tall rosin.

I. In each case 100 gms of either the gum rosin, or the fortified tall oil rosin were heated with various proportions of polyethylene glycol in the presence of 0.1 gm. zinc oxide.

II. 100 gms of the ester product of I was in each case reacted with a substantially stoichiometric amounts of maleic anhydride at 90–100% for 1 hour to form the maleinate half ester.

TABLE 3

| Example | mole wt. of polyglycol | gms of polyglycol per 100 gms rosin | esterification temp. | Duration of heating | gms of maleic anhydride per gms of ester |
|---|---|---|---|---|---|
| 14 | 600 | 199 | 260/270° C. | 5 hours | 11.1 |
| 15 | 400 | 46 | 260/270° C. | 2 hours | 7.6 |
| 16 | 600 | 69 | 260/270° C. | 3 hours | 6.8 |
| 17 | 800 | 92 | 260/270° C. | 3 hours | 5.9 |

Blends were then made up of the above compounds with A.S.A. at 10% and 20% dispersant levels, and tested for water dispersibility. In each case the product gave satisfactory dispersion of A.S.A. at both 10% and 20% based on the total mixture.

I claim:

1. In a water dispersible sizing composition consisting essentially of an active sizing agent and an effective proportion of a dispersant therefor, the improvement which consists in using as said dispersant a polyoxalate of a fortified rosin with a polyalkylene glycol in a proportion up to stoichiometric per mole of fortified rosin acid such that the resultant product is essentially free from terminal hydroxyl groups and has a formula $H_{(v-n)}R(X_mR^1)_n$ wherein R is selected from the group consisting of laevopimarate and partially and wholly fortified laevopimarate groups; each X is selected from the group consisting of ethyleneoxy and propyleneoxy groups; $R^1$ is selected from the group consisting of hydrogen and saturated and unsaturated hydrocarbon and carboxylate groups having from 1 to 20 carbon atoms and such groups optionally substituted with at least one group selected from carboxyl, carboxylic anhydride and hydroxyl groups; v is the average valency of R and has a value of from 1 to 3; n has an average value of from 1 to v; and m has an average value of from 4 to 30.

2. In a water dispersible sizing composition consisting essentially of an active sizing agent and an effective proportion of a dispersant therefor, the improvement which consists in using as said dispersant at least one compound of the formula $H_{(v-n)}R(X_mR^1)_n$ wherein R is selected from the group consisting of laevopimarate and partially and wholly fortified laevopimarate groups; each X is selected from the group consisting of ethyleneoxy and propyleneoxy groups; $R^1$ is selected from maleinate and succinate half ester groups; v is the average valency of R and has a value of from 1 to 3; n has an average value of from 1 to v; and m has an average value of from 4 to 30.

3. A composition according to claim 1 wherein m has an average value of from 6 to 20.

4. A composition according to claim 3 wherein $X_m$ has an average molecular weight less than 1000.

5. In a water dispersible sizing composition consisting essentially of an active sizing agent and an effective proportion of a dispersant therefor, the improvement which consists in using as said dispersant at least one compound of the formula $H_{(v-n)}R(X_mR^1)_n$ wherein R is selected from the group consisting of laevopimarate and partially and wholly fortified laevopimarate groups; each X is selected from the group consisting of ethyleneoxy and propyleneoxy groups; $R^1$ is selected from the group consisting of hydrogen and saturated and unsaturated hydrocarbon and carboxylate groups having from 1 to 20 carbon atoms and such groups substituted with at least one group selected from carboxyl, carboxylic anhydride and hydroxyl groups; v is the average valency of R and has a value of from 1 to 3; n has an average value of from 1 to v; and m has an average value of from 4 to 30; and wherein the active size is a hydrocarbon substituted succinic anhydride formed by the reaction of an olefin having from 6 to 22 carbon atoms with maleic anhydride.

6. A composition according to claim 1 containing from 3 to 50% by weight of said dispersant based on the total weight of said active size and said dispersant.

7. A composition according to claim 6 wherein said proportion of dispersant is between 10 and 30%.

8. A composition according to claim 1 containing an effective proportion of a retention agent.

9. An aqueous emulsion consisting essentially of water and from 0.2 to 15% by weight of a composition as claimed in claim 1.

10. A composition consisting essentially of (A) a hydrocarbon substituted succinic anhydride formed by the reaction of an olefin having from 6 to 22 carbon atoms with maleic anhydride; (B) a dispersant in a total proportion of from 10 to 30% based on the total weight of (A) and (B) said dispersant consisting of an at least partially fortified rosin substituted with from 1 to 3 polyoxyethylene groups per molecule, said polyoxyethylene groups being esterified with a half ester group selected from maleic and succinic half ester groups and said polyoxyethylene chains having an average molecular weight of between 200 and 1000.

11. The composition according to claim 1 wherein $X_m$ has an average molecular weight less than 2000.

12. The composition according to claim 1 wherein m is 4.5 to 30.

13. The composition according to claim 11 wherein m is 6 to 20.

14. The composition according to claim 1 wherein $X_m$ has a molecular weight of less than 2000.

15. The composition according to claim 1, wherein the polyalkylene glycol is polyethylene glycol and 1 to 3 moles of polyethylene glycol are reacted per mole of fortified rosin.

16. The composition according to claim 15, wherein the molar proportion of polyethylene glycol per mole of fortified rosin is less than 2:1 and the polyethylene glycol has a molecular weight in the range from 400 to 1000.

17. The composition according to claim 15, wherein the molar proportion of polyethylene glycol per mole of fortified rosin is more than 2:1 and the polyethylene glycol has a molecular weight in the range from 200 to 600.

18. The composition according to claim 15, wherein the molar proportion of polyethylene glycol per mole of fortified rosin is the range of 1.7:1 to 2.3:1 and the polyethylene glycol has a molecular weight in the range from 400 to 800.

19. The composition of claim 1, wherein the proportion by weight of the dispersant in the composition, based on the total weight of reactive sizing agent and dispersant, is in the range from 1% to 70%.

20. The composition according to claim 19, wherein the proportion by weight of the dispersant is in the range from 3% to 50%.

21. The composition according to claim 20, wherein the proportion of the dispersant is in the range from 10% to 30%.

22. A composition according claim 20, wherein the active sizing agent comprises an alkyl or alkenyl succinic anhydride prepared by reacting an olefin having from 6 to 22 carbon atoms per molecule with maleic anhydride.

23. An aqueous emulsion containing from 0.2% to 15% by weight of a composition according to claim 19.

* * * * *